US009660314B1

(12) United States Patent
Mehta

(10) Patent No.: US 9,660,314 B1
(45) Date of Patent: May 23, 2017

(54) HIGH EFFICIENCY PLASMA TUNABLE ANTENNA AND PLASMA TUNED DELAY LINE PHASER SHIFTER

(71) Applicant: HRL Laboratories, LLC, Malibu, CA (US)

(72) Inventor: Sarabjit Mehta, Calabasas, CA (US)

(73) Assignee: HRL Laboratories, LLC, Malibu, CA (US)

( * ) Notice: Subject to any disclaimer, the term of this patent is extended or adjusted under 35 U.S.C. 154(b) by 441 days.

(21) Appl. No.: 13/949,921

(22) Filed: Jul. 24, 2013

(51) Int. Cl.
*H01Q 1/38* (2006.01)
*H01P 1/18* (2006.01)
*H01Q 9/04* (2006.01)

(52) U.S. Cl.
CPC ..... *H01P 1/184* (2013.01); *H01Q 9/0442* (2013.01)

(58) Field of Classification Search
CPC ..... H01Q 9/0442; H01P 1/184
See application file for complete search history.

(56) References Cited

U.S. PATENT DOCUMENTS 7,626,547 B2 * 12/2009 Schillmeier ..... H01Q 9/0407 343/700 MS
7,821,460 B2 * 10/2010 Schillmeier ..... H01Q 9/0414 343/700 MS
8,113,898 B1 * 2/2012 Wedding ..... H01J 9/241 313/582
8,711,897 B2 * 4/2014 Miles ..... H01P 7/08 333/204
2002/0175869 A1 * 11/2002 Wilcoxson ..... H01J 37/32467 343/742
2005/0082003 A1 * 4/2005 Ishii ..... H01J 37/32192 156/345.41
2005/0162335 A1 * 7/2005 Ishii ..... H01J 37/32541 343/908
2005/0179594 A1 * 8/2005 Morikawa ..... B82Y 10/00 343/700 MS
2010/0101728 A1 * 4/2010 Iwasaki ..... H01J 37/32192 156/345.33

OTHER PUBLICATIONS

B.R. Holland, R. Ramadoss, S. Pandey and P. Agrawal. "Tunable coplanar patch antenna using Varactor" Electronics Letters. Mar. 16, 2006. vol. 42. No. 6.

J.H. Quershi, S. Kim, K. Buisman, C. Huang, et al. "A Low-Loss Compact Linear Varactor Based Phase-Shifter." IEEE Radio Frequency Integrated circuits Symposium. 2007.

* cited by examiner

*Primary Examiner* — Trinh Dinh
(74) *Attorney, Agent, or Firm* — Ladas & Parry

(57) ABSTRACT

A tunable antenna includes a patch antenna including a substrate, a metallic patch mounted on a first side of the substrate, a signal line connected through the substrate to the metallic patch, and a ground plane on a second side of the substrate opposite the first side. The tunable antenna includes an ionizable gas adjacent to the patch antenna.

24 Claims, 9 Drawing Sheets

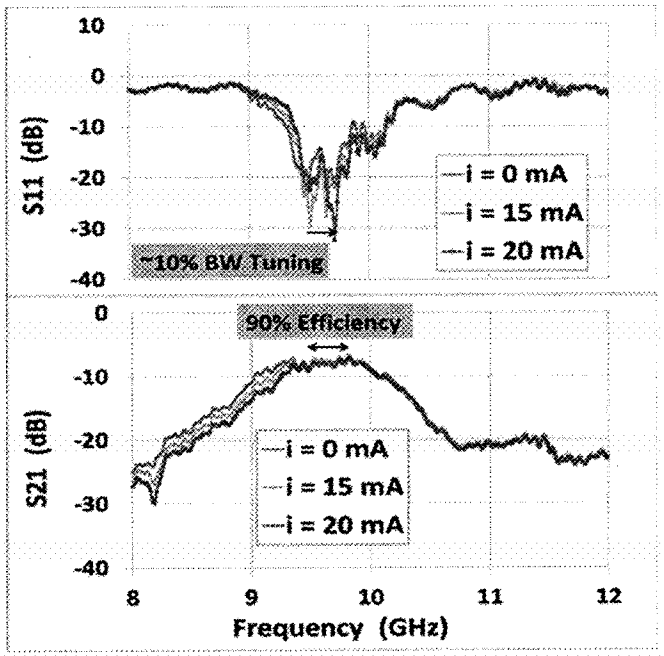
FIG. 7
FIG. 6A
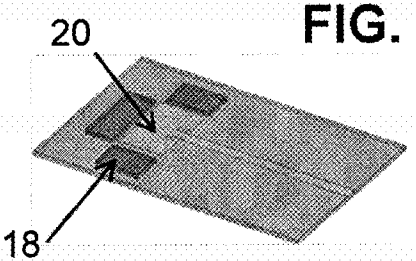
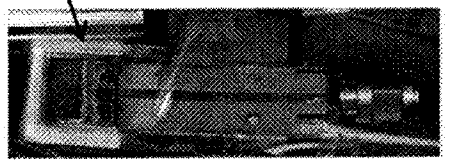
FIG. 6B

HIGH EFFICIENCY PLASMA TUNABLE ANTENNA AND PLASMA TUNED DELAY LINE PHASER SHIFTER

CROSS REFERENCE TO RELATED APPLICATIONS

None

TECHNICAL FIELD

This disclosure relates to tunable antennas and tunable delay lines, and in particular to tunable patch antennas and tunable delay line phase shifters.

BACKGROUND

A tunable antenna is desirable for many applications. For example in the communications field the increasing number of global wireless standards require that either a tunable antenna be used that can be operated in various frequency bands, or the deployment of an antenna for each frequency band, which requires multiple antennas. A system with multiple antennas is more expensive than a system with a tunable antenna. Also a system with multiple antennas has practical disadvantages, such as size and where to locate the multiple antennas.

In the prior art tunable antennas have been described that use varactor diodes for frequency tuning. Varactor diodes provide a method of varying the capacitance within a circuit by the application of a control voltage. One example in the prior art is described in "Tunable coplanar patch antenna using Varactor" by B. R. Holland, R. Ramadoss, S. Pandey and P. Agrawal, Electronics Letters 16th March 2006 Vol. 42 No. 6, which describes a coplanar patch antenna that is tuned using a varactor diode 40 on one of the radiating edges, as shown in the circuit diagram of FIG. 1 and the circuit layout of FIG. 2.

Tunable phase shifters are also important components in many microwave subsystems, including radars and communication systems. In these systems, the radiation pattern or reception pattern of the antenna may be steered without any mechanical movement by shifting the phase of each individual antenna element. In the prior art various phase shifters have been presented, including varactor diodes, MEMS based varactors, PIN diode phase shifters, and barium strontium titanate (BST) varactors.

For example, in "A Low-Loss Compact Linear Varactor Based Phase-Shifter" by J. H. Qureshi, S. Kim, K. Buisman, C. Huang, M. J. Pelk, A. Akhnoukh, L. E. Larson, L. K. Nanver and L. C. N. de Vreede, 2007 IEEE Radio Frequency Integrated Circuits Symposium, a varactor based phase shifter is described. As shown in FIG. 8, Qureshi et al. describe a transmission line based true-time-delay phase shifter that can be approximated by a ladder network composed of inductors and capacitors. However, due to the difficulty of implementing variable inductors, Qureshi et al. state that most practical true-time-delay phase shifters vary the capacitance 80 using MEMS or Schottky based varactor diodes.

Varactor diodes have the disadvantage of being extremely lossy, and tuning the frequency of an antenna using varactor diodes may be only 20 percent efficient, such as in the X-band frequency range. The losses due to varactor diodes significantly reduce antenna gain, which negatively impacts the range of radar or communication systems.

Current approaches for tunable delay line phases shifters are also extremely lossy and are slow to respond. The insertion loss can exceed 2-3 dB for a 360 degree phase shift, and the response time may be as slow as 1000 nanoseconds (ns).

What is needed is a tunable frequency antenna that has high efficiency and low loss. Also needed is a tunable delay line phase shifter with low loss and fast response time. The embodiments of the present disclosure answer these and other needs.

SUMMARY

In a first embodiment disclosed herein, a tunable antenna comprises a patch antenna comprising a substrate, a metallic patch mounted on a first side of the substrate, a signal line connected through the substrate to the metallic patch, and a ground plane on a second side of the substrate opposite the first side, and an ionizable gas adjacent to the patch antenna.

In another embodiment disclosed herein, a tunable delay line phase shifter comprises a transmission line, a substrate, the transmission line on the substrate, at least one electrode on the substrate, and an ionizable gas adjacent to the transmission line.

In still another embodiment disclosed herein, a method of providing a tunable antenna comprises providing a patch antenna comprising a substrate, a metallic patch mounted on a first side of the substrate, a signal line connected through the substrate to the metallic patch, and a ground plane on a second side of the substrate opposite the first side, and providing an ionizable gas adjacent to the patch antenna.

In yet another embodiment disclosed herein, a method of providing a tunable delay line phase shifter comprises providing a transmission line, providing a substrate, the transmission line on the substrate, providing at least one electrode on the substrate, and providing an ionizable gas adjacent to the transmission line.

These and other features and advantages will become further apparent from the detailed description and accompanying figures that follow. In the figures and description, numerals indicate the various features, like numerals referring to like features throughout both the drawings and the description.

BRIEF DESCRIPTION OF THE DRAWINGS

FIG. 6A shows a HFSS model of a plasma-integrated patch antenna and FIG. 6B shows a top view of a patch antenna with plasma integrated along three edges in accordance with the present disclosure;

FIG. 7 shows graphs of a measured frequency shift and gain for the plasma tuned patch antenna of FIG. 6B in accordance with the present disclosure;

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
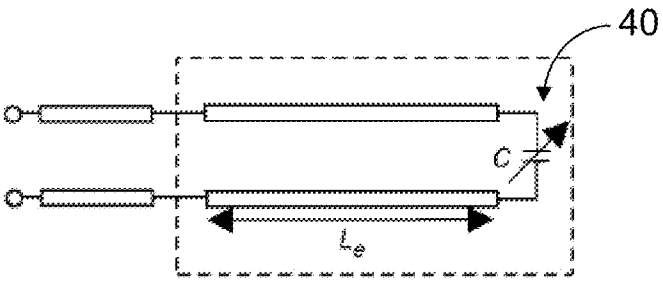
FIG. 1 PRIOR ART
FIG. 1 shows a circuit diagram of a tunable patch antenna in accordance with the prior art.
Figure 2:
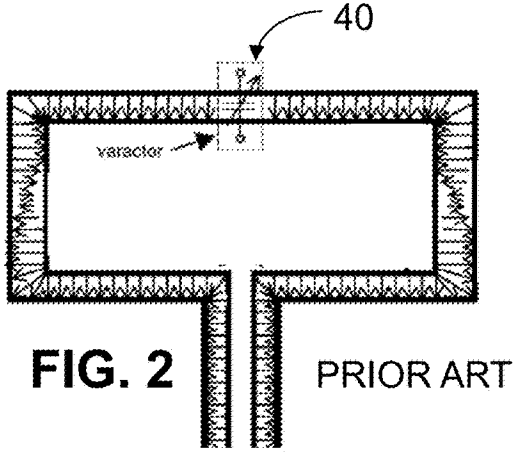
FIG. 2 PRIOR ART
FIG. 2 shows a circuit layout for the tunable patch antenna of FIG. 1 in accordance with the prior art.
Figure 3:
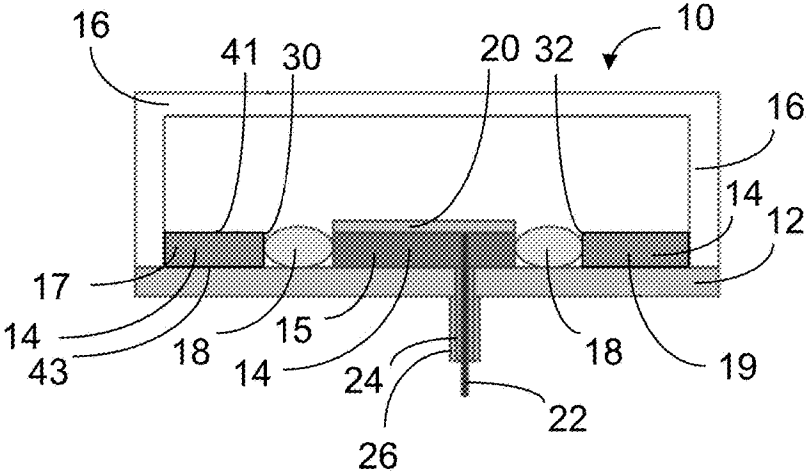
FIG. 3 shows a plasma-tuned patch antenna structure in accordance with the present disclosure.

FIG. 3 shows a plasma-tuned patch antenna structure 10 in accordance with the present disclosure. The plasma medium 18 has unique properties depending on the electron density in the plasma 18, which is an ionized gas. The plasma 18 can act as a dielectric or a conductor. At high frequencies the plasma 18 may act more as a dielectric and at low frequencies the plasma 18 may act more as a conductor. The plasma tuned antenna 10 integrates a stable low loss, low noise dc plasma discharge 18 near the edges of patch 20. By varying the plasma electron density, the effective plasma dielectric constant may be varied to tune the resonant frequency of the patch antenna.

The antenna frequency for a plasma tuned antenna can be tuned with high efficiency. Prior art approaches, such as those discussed above, utilize varactors that are extremely lossy, especially at lower frequencies, and which can provide only about 20% efficiency for X band, resulting in significant antenna gain reduction. A patch antenna according to the present disclosure can be fabricated on a standard radio frequency (RF) substrate 14, which can be Duroid™, thermoplastic materials, silicon, alumina, or other suitable materials, such as laminates. For example, XT/Duroid™ 8000 and XT/Duroid™ 8100 are thermoplastic circuit materials that are excellent for high frequency/high speed applications, as the dielectric constant of the materials are stable over a wide range of frequencies.

Typical dimensions for a rectangular X-band patch antenna on a Duroid™ substrate 14 with a permittivity of Er=3, are about 0.2"×0.3". As shown in FIG. 3, the substrate 14 may have a first portion 15, a second portion 17, and a third portion 19. The substrate also has a first side 41 and a second side 43. A first cavity 30 is between the first portion 15 of the substrate 14 and the second portion 17 of the substrate 14. A second cavity 32 is between the first portion 15 of the substrate 14 and the third portion 19 of the substrate 14. The two cavities 30, 32 are created in the substrate 14 on either side of the first portion 15 of the substrate 14. A metallic patch 20 is on the first side 41 of the first portion 15 of the substrate 14. An ionizable gas 18, which may be helium (He), neon (Ne) or argon (Ar) at a low pressure of 1-10 Torr, is in the first cavity 30 and the second cavity 32, as shown in FIG. 3.

The patch metal 20 and the ground plane 12, which is on the second side 43 of the substrate 14, serve as the two discharge electrodes to change the ionizable gas 18, into an ionized gas or plasma 18. A low loss cover 16 mounted to the ground plane 12 provides a hermetically sealed chamber for the substrate 14, plasma 18 and patch metal 20.

A signal line 22 is connected to the patch metal 20 and insulated from the ground plane 12 by insulator 24. The signal line 22 may be a coax and have a shielding 26, as shown in FIG. 3. The signal line 22 can be used to provide a dc voltage and an RF signal to the patch metal 20.

Upon applying an appropriate dc voltage of approximately 50 to 500 volts between the patch metal 20, as the anode, and the ground plane 12, as the cathode, the ionizable gas 18 is ionized and a direct current (dc) glow discharge plasma 18 is created. The electron density in the plasma 18, and hence the relative permittivity can be controlled by changing the discharge voltage and current. As the plasma relative permittivity is varied, the patch antenna resonance frequency is tuned.

Figure 4:
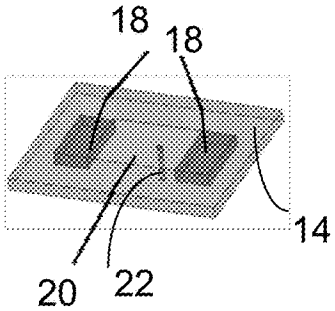
FIG. 4 shows a HFSS model of a plasma-integrated patch antenna in accordance with the present disclosure.
Figure 5:
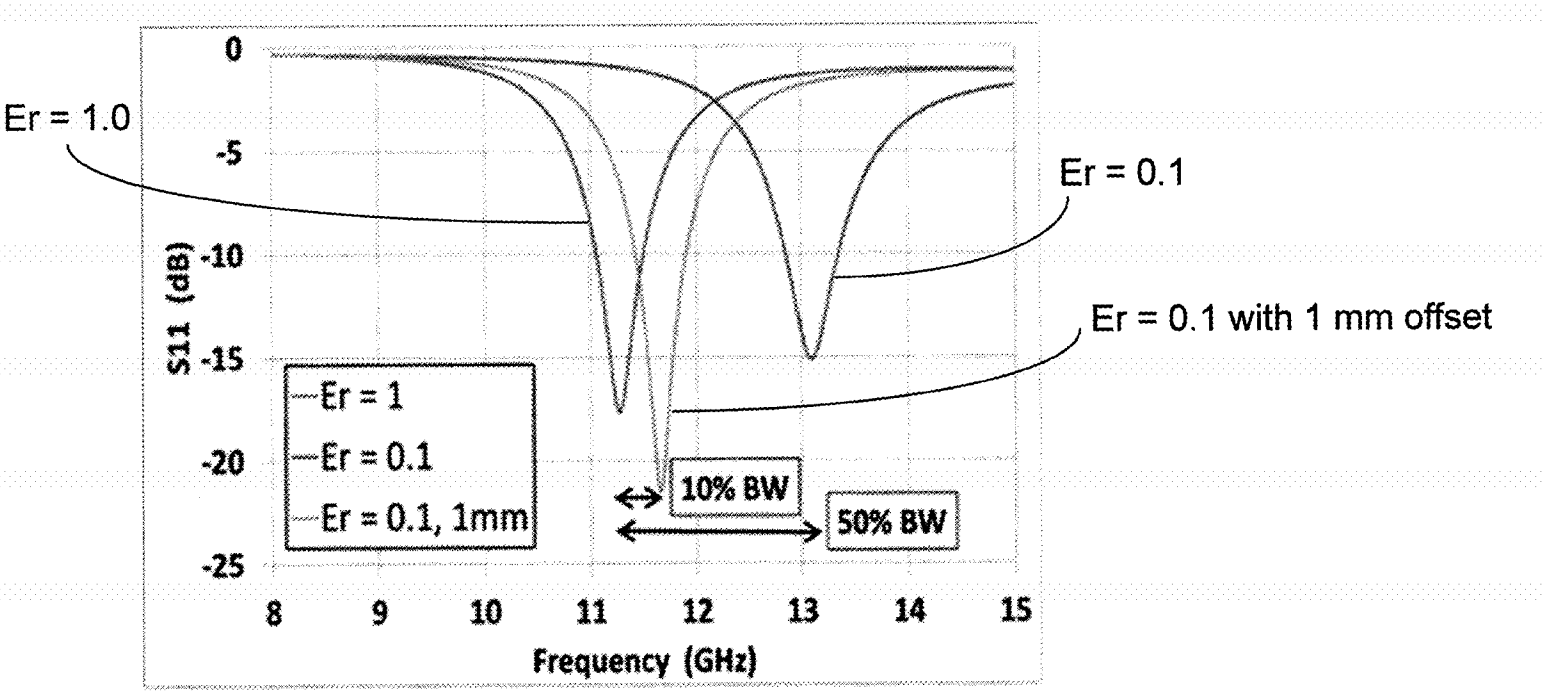
FIG. 5 shows a graph of a simulation of frequency tuning as the plasma electron density is varied in accordance with the present disclosure.
Figure 8:
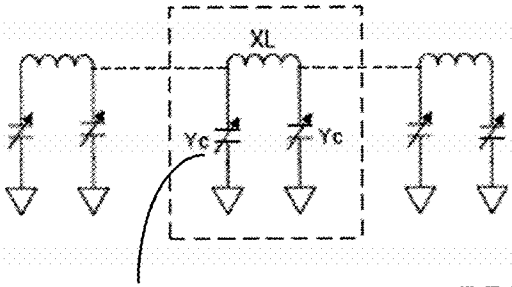
PRIOR ART FIG. 8
FIG. 8 shows a transmission line based true-time-delay phase shifter approximated by a ladder network composed of inductors and varactors in accordance with the prior art.

FIG. 4 shows a HFSS model of the plasma-integrated patch antenna, and FIG. 5 shows the simulated frequency tuning as the plasma electron density is varied in the plasma 18. The tuning range is sensitive to the exact position of the plasma 18 relative to the patch metal 20. As shown in the simulation graph of FIG. 5, a 1 millimeter (mm) lateral offset of the plasma 18 from the patch metal 20 reduces the tuning range from about a 50% bandwidth range to a 10% bandwidth range at X-band. Thus, it is advantageous to locate the plasma 18 close to the patch metal 20.

FIG. 6A shows a HFSS model of another plasma-integrated patch antenna and FIG. 6B shows a top view of the patch antenna of FIG. 6A with plasma 18 integrated along three edges in accordance with the present disclosure. FIG. 7 shows graphs for the measured frequency shift and gain for the plasma tuned patch antenna of FIG. 6B. As the discharge current and plasma density is increased the effective permittivity Er of the plasma 18 decreases shifting the resonant frequency of the patch to higher values. As shown in FIG. 7 the antenna efficiency remains high at about 90% over 10% of the tuning range or 0.4 GHz of the 8-12 GHz GHz tuning range.

Figure 9:
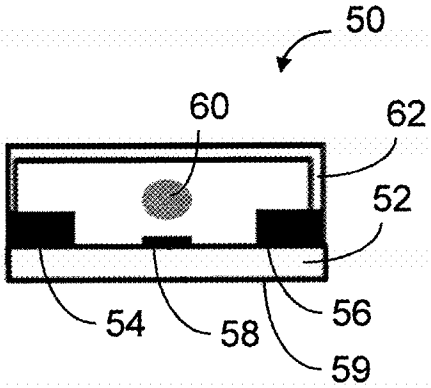
FIG. 9 shows a plasma-tuned delay line phase shifter in accordance with the present disclosure.

FIG. 9 shows a cross section of a plasma-tuned delay line phase shifter 50 in accordance with the present disclosure. As discussed above, the plasma medium 60 has unique properties depending on the electron density, and can act as a dielectric or conductor. The plasma-tuned delay line phase shifter 50 integrates a stable low loss, low noise direct current (dc) plasma discharge 60 near the RF transmission line structure 58. As the plasma electron density in the plasma 60 is varied, the effective plasma dielectric constant changes, which shifts the transmission phase of the RF transmission line 58.

As discussed above, prior art approaches are extremely lossy, and slow to respond. The insertion losses for the prior art can exceed 2-3 dB for a 360 deg phase shift, and have slow response time of 1000 nanoseconds. The plasma-tuned delay line phase shifter 50 of the present disclosure enables a fast response broadband tunable delay line phase shifter with <0.5 dB insertion loss.

As shown in FIG. 9, the plasma-tuned delay line phase shifter 50 has a transmission line, which may be an radio frequency (RF) line, such as microstrip line 58, fabricated on a standard substrate 52, such as Duroid™, thermoplastic materials, alumina, silicon, or any other suitable substrate. A typical width for an X-band microstrip line 58 on a permittivity Er=3 Duroid™ substrate 52, which may be a Roger's Corporation RO3003™ laminate material, is approximately 0.075 inches. A ground plane 59 is on the on the side of the substrate opposite the microstrip line 58, which results in an approximately 50 ohm transmission line 58. Two electrodes 54 and 56 on the substrate 52 are located on either side of the microstrip line 58, and the gap between the two electrodes may be 10 mm, and a space between the microstrip line 58 and electrode 54 may be the same as a space between the microstrip line 58 and electrode 56.

The entire structure can be enclosed by a low loss cover 62 and the cavity filled with a discharge gas or plasma, such as helium (He), neon (Ne), or argon (Ar) at a low pressure of about 1 to 10 Torr to provide a hermetically sealed chamber over the microstrip line 58, the electrodes 54 and 56, and the plasma 60.

The RF microstrip line 58 and the electrodes 54 and 56 serve as the two discharge electrodes for the plasma 60. On applying an appropriate direct current (dc) voltage of about 50 to 500 volts between the transmission line 58, as the anode, and the two electrodes 54 and 56, as the cathode, a dc glow discharge or plasma 60 is created. The electron density in the plasma 60, and hence the relative permittivity, can be controlled by changing the dc discharge voltage/current. As the plasma relative permittivity is varied, the transmission phase of the RF transmission line structure 58 is shifted.

Figure 11:
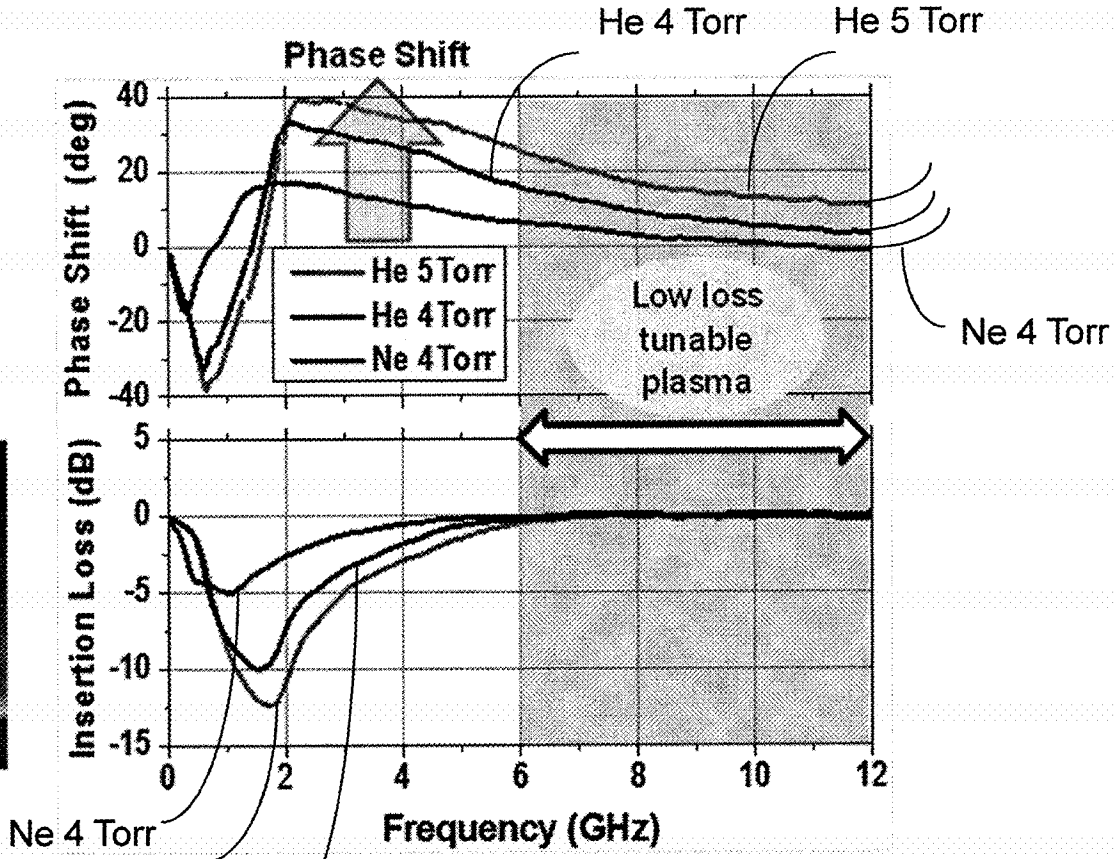
FIG. 11 shows measured data for the plasma-integrated delay line phase shifter of FIG. 10 in accordance with the present disclosure.
Figure 10:
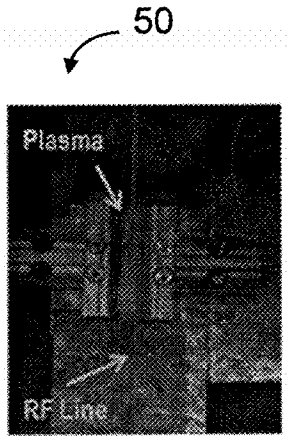
FIG. 10 shows a plasma-integrated delay line phase shifter in accordance with the present disclosure.

FIG. 10 shows a plasma-integrated delay line phase shifter 50 fabricated in accordance with the present disclosure. FIG. 11 shows measured transmission phase shift and insertion loss data for the plasma-integrated delay line phase shifter 50 of FIG. 10. The plasma 60 reduces the effective permittivity Er for the transmission line 58, resulting in an upward phase shift.

The insertion loss is pressure and frequency dependent. FIG. 11 shows phase shift and insertion loss measurements for He 5 Torr, He 4 Torr, and Ne 4 Torr. The measured data shows that over a wide frequency range of 6-12 GHz, the insertion loss for the plasma-integrated delay line phase shifter 50 is quite low.

Figure 12A:
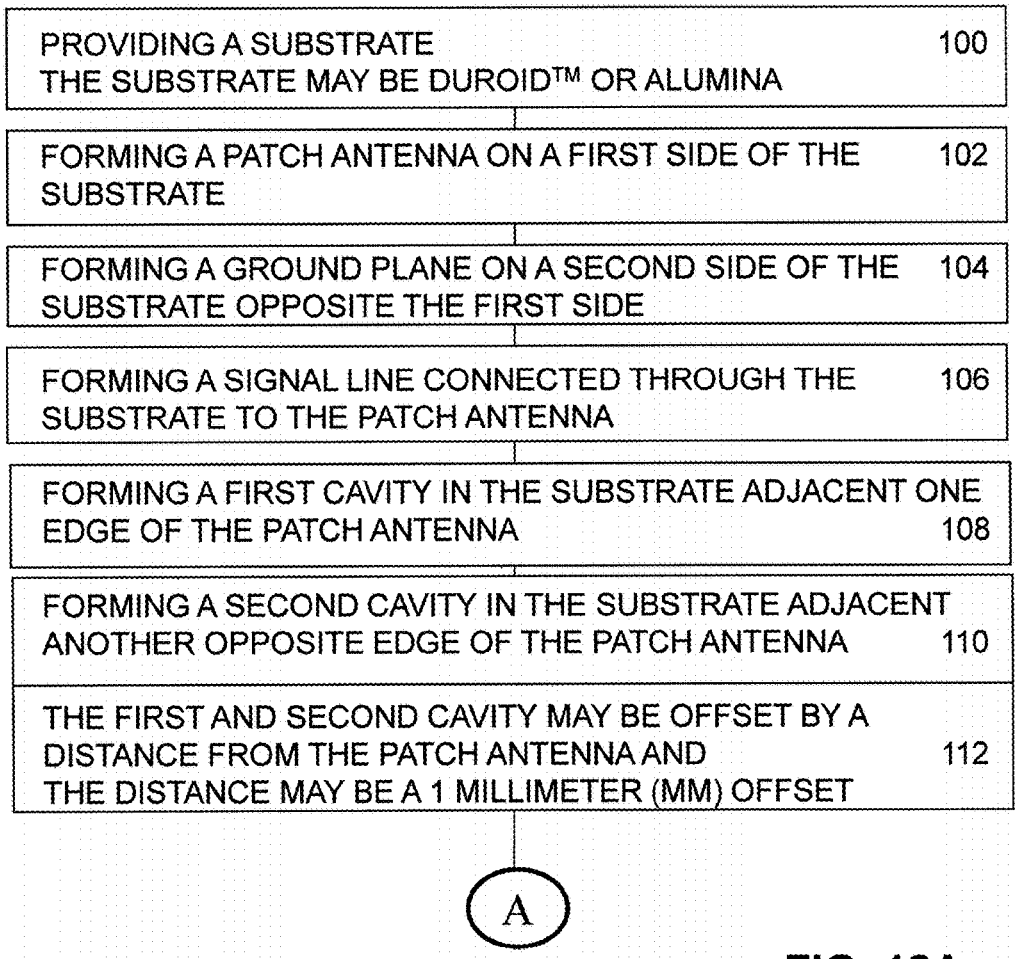
FIGS. 12A and 12B are flow charts of a method of providing a plasma-tuned patch antenna structure in accordance with the present disclosure.
Figure 12B:
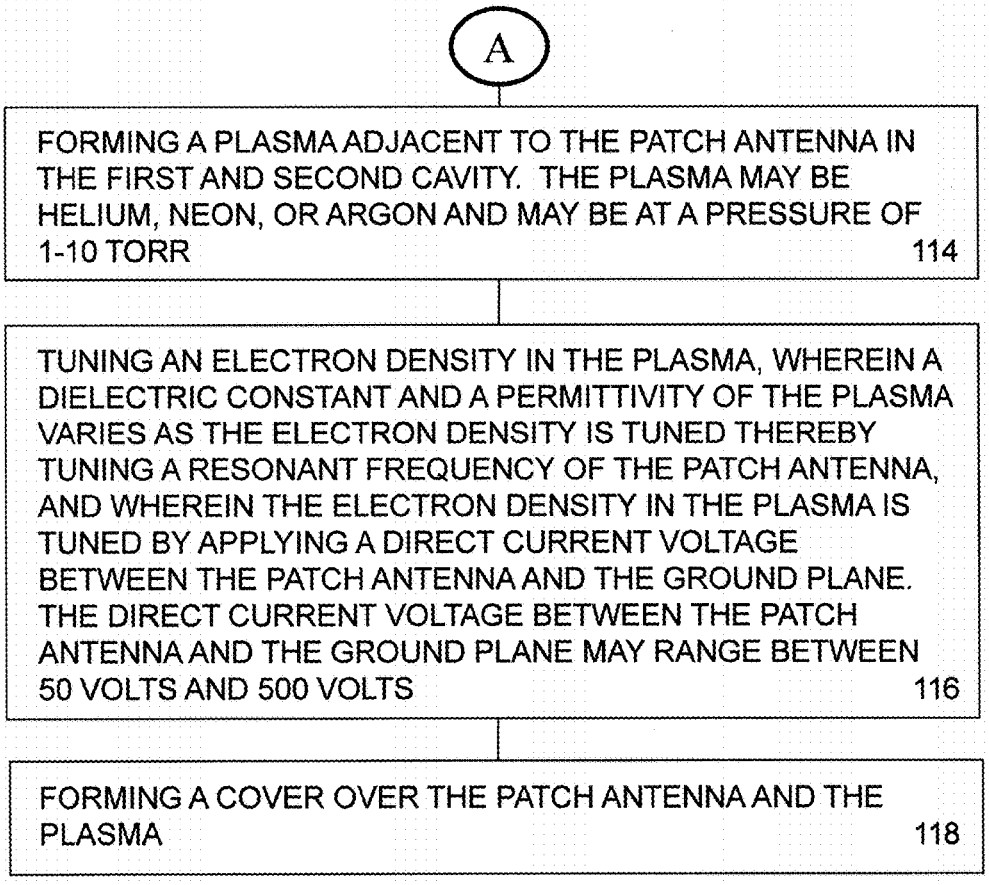

FIGS. 12A and 12B are flow charts of a method of providing a plasma-tuned patch antenna structure in accordance with the present disclosure. In step 100 a substrate is provided. The substrate may be Duroid™, thermoplastic materials, silicon, alumina, or other suitable materials such as laminates. In step 102 a patch antenna is formed on a first side of the substrate. Then in step 104 a ground plane is formed on a second side of the substrate opposite the first side. In step 106 a signal line is connected through the substrate to the patch antenna. In step 108 a first cavity is formed in the substrate adjacent one edge of the patch antenna, and in step 110 a second cavity is formed in the substrate adjacent another opposite edge of the patch antenna. As described in step 112, the first and second cavity may be offset by a distance from the patch antenna and the distance may be a 1 millimeter (mm) offset. Then in step 114 a plasma is formed adjacent to the patch antenna in the first and second cavity. The plasma gas may be helium, neon, or argon and may be at a pressure of 1-10 Torr. Next in step 116 an electron density in the plasma is tuned, wherein a dielectric constant and a permittivity of the plasma varies as the electron density is tuned thereby tuning a resonant frequency of the patch antenna. The electron density in the plasma is tuned by applying a direct current voltage between the patch antenna and the ground plane and the direct current voltage between the patch antenna and the ground plane may range between 50 volts and 500 volts. Then in step 118 a cover is formed over the patch antenna and the plasma.

Figure 13A:
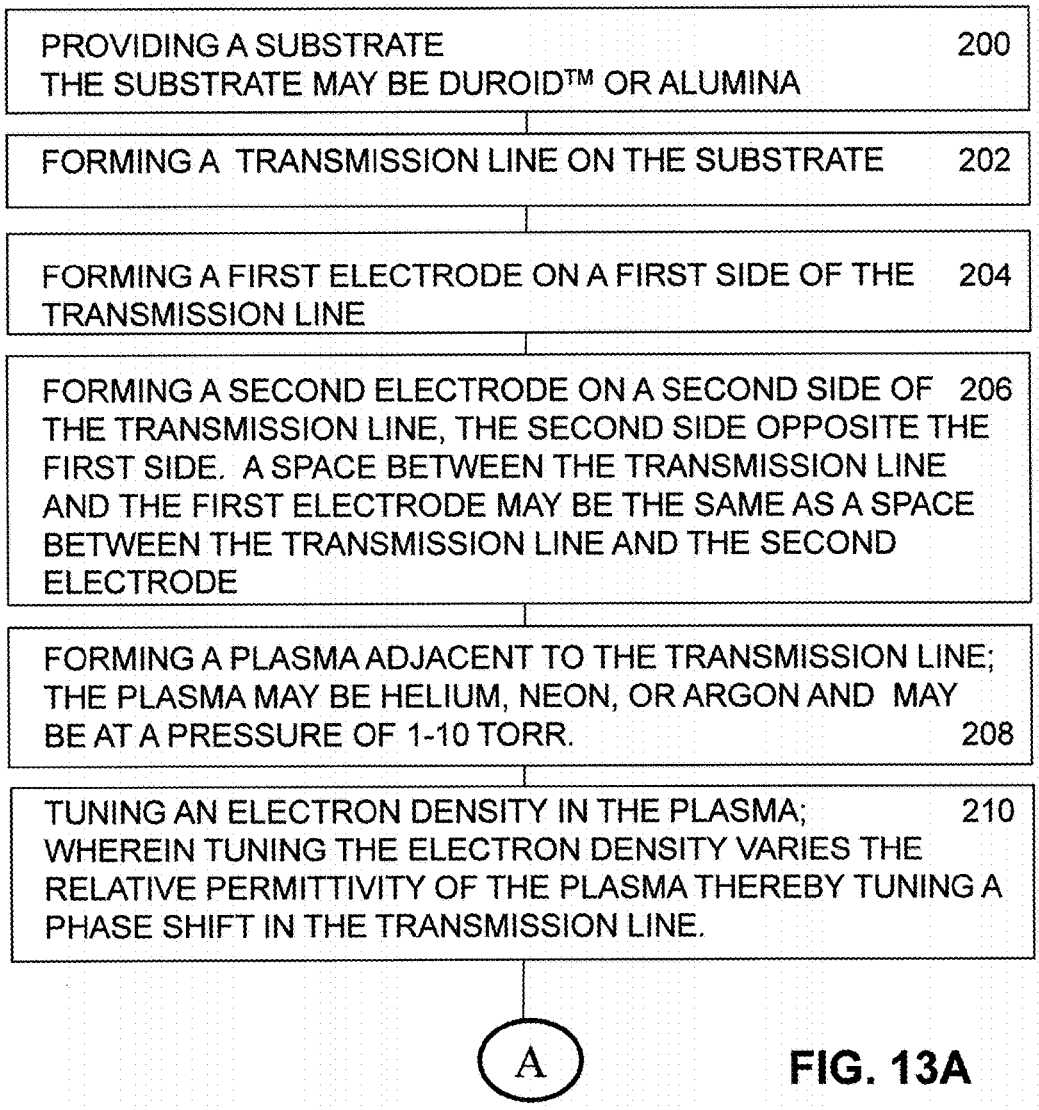
FIGS. 13A and 13B are flow charts of a method of providing a plasma-tuned delay line phase shifter in accordance with the present disclosure.
Figure 13B:
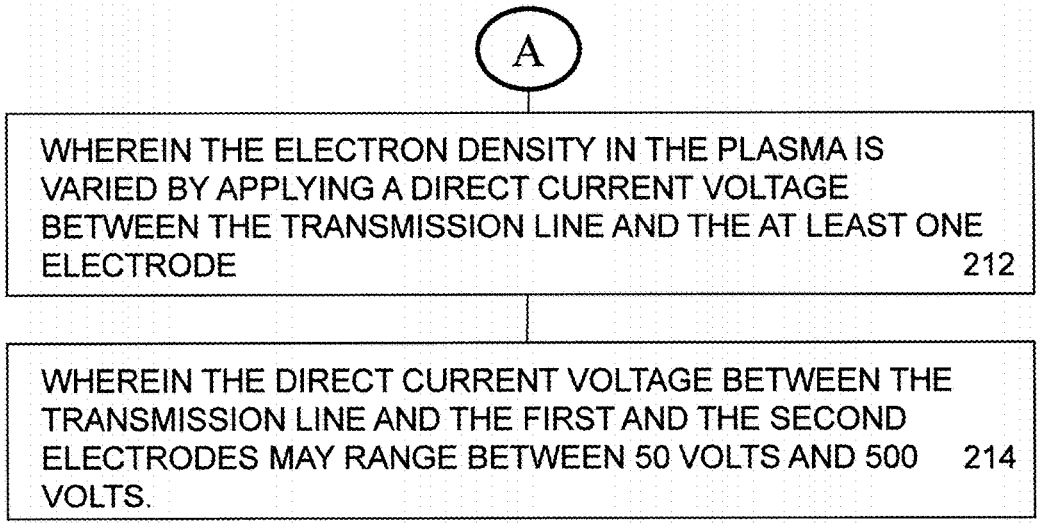

FIGS. 13A and 13B are flow charts of a method of providing a plasma-tuned delay line phase shifter in accordance with the present disclosure. In step 200 a substrate is provided. The substrate may be Duroid™, thermoplastic materials, silicon, alumina, or other suitable materials, such as laminates. Then in step 202 a transmission line is formed on the substrate. Next in step 204 a first electrode is formed on a first side of the transmission line and in step 206 a second electrode is formed on a second side of the transmission line, the second side being opposite the first side. A space between the transmission line and the first electrode may be the same as a space between the transmission line and the second electrode. Next in step 208 a plasma is formed adjacent to the transmission line. The plasma may be helium, neon, or argon and may be at a pressure of 1-10 Torr. Then in step 210 an electron density in the plasma is tuned. Tuning the electron density varies the relative permittivity of the plasma thereby tuning a phase shift in the transmission line. As described in step 212 the electron density in the plasma is varied by applying a direct current voltage between the transmission line and the at least one electrode, and as described in step 214 the direct current voltage between the transmission line and the first and second electrode may range between 50 volts and 500 volts.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . . "

What is claimed is:

1. A tunable antenna comprising:

a patch antenna comprising:

a substrate, wherein the substrate comprises a first portion of the substrate and a second portion of the substrate, and wherein the substrate has a first side and a second side opposite the first side;

a first cavity located between the first portion of the substrate and the second portion of the substrate;

a metallic patch on the first side of the first portion of the substrate;

a signal line connected through the substrate to the metallic patch;

a ground plane on the second side of the substrate opposite the first side;

wherein the first cavity extends to the ground plane; and an ionizable gas located in the first cavity.

2. The tunable antenna of claim 1 wherein when a direct current voltage is applied to the metallic patch, the ionizable gas is ionized to form a plasma.

3. The tunable antenna of claim 2 wherein as an electron density in the plasma is varied by changing the direct current voltage, a permittivity of the plasma varies and a resonant frequency of the patch antenna varies.

4. The tunable antenna of claim 2 wherein the direct current voltage between the metallic patch and the ground plane ranges between 50 volts and 500 volts.

5. The tunable antenna of claim 2 wherein the plasma is offset by a distance from the metallic patch.

6. The tunable antenna of claim 5 wherein the distance is a 1 millimeter (mm) offset.

7. The tunable antenna of claim 1 wherein the ionizable gas comprises helium (He), neon (Ne), or argon (Ar).

8. The tunable antenna of claim 1 further comprising at least one cavity in the substrate near an edge of the metallic patch.

9. The tunable antenna of claim 1 further comprising:

a first cavity in the substrate adjacent one edge of the metallic patch; and a second cavity in the substrate adjacent another opposite edge of the metallic patch;

wherein the first and second cavity contain the ionizable gas at a pressure of 1-10 Torr.

10. The tunable antenna of claim 1 wherein the substrate comprises Duroid™, thermoplastic materials, silicon, alumina, or laminates.

11. The tunable antenna of claim 1 wherein the patch antenna further comprises:

a third portion of the substrate;

a second cavity located between the first portion of the substrate and the third portion of the substrate, wherein the second cavity extends to the ground plane;

and the ionizable gas located in the first cavity and in the second cavity.

12. The tunable antenna of claim 1 wherein the patch antenna further comprises:

a cover coupled to the substrate for providing a hermetically sealed chamber for the substrate, the ionizable gas and the metallic patch.

13. A method of providing a tunable antenna comprising:

providing a patch antenna comprising:

a substrate, wherein the substrate comprises a first portion of the substrate and a second portion of the substrate, and wherein the substrate has a first side and a second side opposite the first side;

a first cavity located between the first portion of the substrate and the second portion of the substrate;

a metallic patch on the first side of the first portion of the substrate;

a signal line connected through the substrate to the metallic patch;

a ground plane on the second side of the substrate opposite the first side;

wherein the first cavity extends to the ground plane; and providing an ionizable gas located in the first cavity.

14. The method of claim 13 further comprising:

applying a direct current voltage to the metallic patch to ionize the ionizable gas to form a plasma.

15. The method of claim 14 wherein as an electron density in the plasma is varied by changing the direct current voltage, a permittivity of the plasma varies and a resonant frequency of the patch antenna varies.

16. The method of claim 14 wherein the direct current voltage between the metallic patch and the ground plane ranges between 50 volts and 500 volts.

17. The method of claim 14 wherein the plasma is offset by a distance from the metallic patch.

18. The method of claim 17 wherein the distance is a 1 millimeter (mm) offset.

19. The method of claim 13 wherein the ionizable gas comprises helium (He), neon (Ne), or argon (Ar).

20. The method of claim 13 further comprising providing at least one cavity in the substrate near an edge of the metallic patch.

21. The method of claim 13 further comprising:

providing a first cavity in the substrate adjacent one edge of the metallic patch; and providing a second cavity in the substrate adjacent another opposite edge of the metallic patch;

wherein the first and second cavity contain the ionizable gas at a pressure of 1-10 Torr.

22. The method of claim 13 wherein the substrate comprises Duroid™, thermoplastic materials, silicon, alumina, or laminates.

23. The method of claim 13 wherein the patch antenna further comprises:

a third portion of the substrate;

a second cavity located between the first portion of the substrate and the third portion of the substrate, wherein the second cavity extends to the ground plane;

and the ionizable gas located in the first cavity and in the second cavity.

24. The method of claim 13 wherein the patch antenna further comprises:

a cover coupled to the substrate for providing a hermetically sealed chamber for the substrate, the ionizable gas and the metallic patch.

* * * * *